United States Patent [19]

Semones et al.

[11] 3,979,858

[45] Sept. 14, 1976

[54] CHEMICALLY ACCELERATED METAL FINISHING PROCESS

[75] Inventors: Donald E. Semones, Mentor; William H. Safranek, Columbus, both of Ohio

[73] Assignee: International Lead Zinc Research Organization, Inc., New York, N.Y.

[22] Filed: July 24, 1975

[21] Appl. No.: 598,704

[52] U.S. Cl. ..... 51/316; 51/306

[51] Int. Cl.[2] ..... E06B 7/28

[58] Field of Search ..... 51/316, 306

[56] References Cited

UNITED STATES PATENTS

| | | | |
|---|---|---|---|
| 2,978,850 | 4/1961 | Gleszer | 51/316 |
| 2,994,165 | 8/1961 | Brevik | 51/316 |
| 3,161,997 | 12/1964 | Balz | 51/316 |
| 3,543,452 | 12/1970 | Guenther | 51/316 |

FOREIGN PATENTS OR APPLICATIONS

| | | | |
|---|---|---|---|
| 142,978 | 4/1949 | Australia | 51/316 |

*Primary Examiner*—Al Lawrence Smith
*Assistant Examiner*—Robert C. Watson
*Attorney, Agent, or Firm*—Brumbaugh, Graves, Donohue & Raymond

[57] ABSTRACT

A process for barrel finishing, vibratory finishing, deburring or polishing the surface of a metal workpiece such as a zinc die casting is described. The article to be finished is subjected to agitation in a rotating barrel or a vibratory machine containing abrasive media and an aqueous accelerator solution of a lower aliphatic acid having at least two and not more than six carbon atoms. The accelerator solution may also contain sodium bisulfate. In the process, the accelerator solution is added to or flushed through the finishing apparatus.

16 Claims, No Drawings

CHEMICALLY ACCELERATED METAL FINISHING PROCESS

BACKGROUND OF THE INVENTION

The present invention pertains to the art of mechanical surface polishing of metals or metal workpieces particularly zinc die castings. The process described pertains to the fields known as barrel finishing and vibratory finishing in which workpieces are subjected to controlled agitation. In barrel finishing, barrels containing metal workpieces, abrasive media and a liquid are rotated at a designated speed. In vibratory finishing, machines are designed to vibrate metal workpieces, abrasive media and liquid at a designated frequency and amplitude. The constant agitation of the article to be deburred, polished or finished in the presence of an abrasive medium and liquid solution produces a scrubbing action that operates to finish the external areas of the workpiece uniformly and remove burrs. The present invention combines the mechanical process of barrel rotation or machine vibration with the chemical reaction between a metal and a dilute aliphatic acid solution to obtain a finished metal workpiece at low cost and in the shortest possible time.

The polishing of metals mechanically and electrolytically has been known for many years. In the electrolytic field, the combination of strong acids and high voltage creates mechanical and physical hazards and frequently result in considerable metal loss during processing. This has led to the desire for less hazardous polishing methods such as mechanical processes involving chemicals which do not react as strongly with metals as do the concentrated acids such as hydrofluoric, sulfuric, and hydrochloric acids. Barrel finishing for polishing metals is characteristically very slow, typically requiring from 6 to 12 hours. Furthermore, the impingement of workpieces against other workpieces generally results in indentations that impair the final surface finish. The use of vibratory processes for finishing metals is increasing primarily because of lower cost and elimination of the hazards resulting from the use of high voltage. Among the advantages of vibratory finishing processes are: (1) shorter processing times; (2) more uniform action over both recessed and exposed surface areas; (3) reduction of undesirable effects such as impingement or exposure of subsurface defects; (4) more effective use of processing capacity; (5) capability of finishing recesses, slots or holes; and (6) use of an apparatus that allows for easy inspection of the workpiece during operation. The present invention uses a new chemical accelerator solution in the conventional barrel and vibratory finishing processes to shorten the finishing time while still providing a smooth uniform surface for the castings.

It is an object of this invention to provide an economical one-step process for polishing metals using a chemical accelerator solution in a barrel or vibratory finishing process to obtain smooth smut-free surface finishes in the shortest possible time.

It is further an object of the invention to provide an accelerator solution which is readily disposable because it is biodegradable. This eliminates the need for chemical treatment of used solution prior to discarding it.

It is further an object of the invention to provide an accelerator solution in a pH range that allows for non-hazardous handling yet effectively accelerates the polishing process. Such a solution can be prepared from starting materials which can be characterized as stable solids capable of being weighed precisely and readily soluble in water.

Previous mechanical vibratory finishing and barrel finishing processes have used various liquid solutions to facilitate the finishing process, such as water, soap or detergent solutions, and dilute or concentrated inorganic acid solutions. Such processes frequently require several steps in which the abrasive media or the solution is replaced in successive stages. For example, a strong acid solution, used initially to remove extremely rough surfaces, must be replaced by a weak acid solution to obtain a uniformly smooth surface finish.

In an article published in the Journal *Plating* by Safranek and Miller, January, 1972, an accelerator solution consisting of sodium dichromate and sodium bisulfate is described. This sodium dichromate-sodium bisulfate solution presented certain practical difficulties which are eliminated in the present invention. Whereas the removal of hexavalent chromium from the rinse water waste is necessary in the prior process, the present accelerator solution does not require chemical treatment before disposing of the rinse water waste. Furthermore, dichromate is generally considered to be a passivating agent, that is, it possesses the property of changing a chemically active surface of a metal to a less reactive state. Finally, whereas in the earlier process, finishing required two one-hour steps using a different abrasive medium for each step, in the present invention, finishing may be accomplished in a single half-hour step usng only one abrasive medium.

SUMMARY OF THE INVENTION

This invention relates to a process for the barrel finishing or vibratory finishing of metal objects. In the process, metal workpieces are placed in a rotating barrel or vibratory machine which contains abrasive media and an aqueous solution of a lower aliphatic acid having at least two and not more than six carbon atoms. The accelerator solution may also contain sodium bisulfate.

In accordance with the process of this invention, metal workpieces such as zinc die castings are subjected to vibratory action in a machine containing abrasive media and a chemical accelerator solution, or are agitated in a rotating barrel containing abrasive media and a chemical accelerator solution. Typically, zinc die castings are alloys containing predominantly zinc and minor amounts of other metals such as aluminum, copper or magnesium.

For the purposes of this invention, the chemical accelerator solution may be an aqueous solution of a lower aliphatic acid having from two to six carbon atoms. Included among the preferred accelerator acids are the dicarboxylic and hydroxy acids such as: tartaric, citric, glycolic, lactic, malic, and maleic. These acids may be characterized as having at least two carboxyl groups or as having at least one carboxyl and one hydroxyl group. The accelerator solution is an aqueous solution prepared by adding 5 to 25 grams of aliphatic acid per liter of solution. The pH of the solution is maintained in the range 1.1 to 1.9. Sodium bisulfate may be added to the solution at a concentration in the range 1 to 40 grams per liter of solution as a pH buffer to maintain the pH range above. This has the effect of maximizing the rate at which metal is removed.

Abrasive media which may be used in the process include ceramic, quartz, aluminum oxide, carborundum and resin-bonded abrasive particles. These particles may range in size from 5 to 100 microns ($\mu$m) in diameter, preferaby 5 to 10 microns in diameter, embedded in preformed cubes or cones of plastic material such as polyester.

The vibratory finishing machines used may vibrate in the range 1200 to 3600 cycles per minute (cpm) with an amplitude of 0.0625 to 0.25 inch. Using the chemical accelerator described, the surfaces of the zinc metal workpieces can be polished to a surface finish of 3 to 5 microinches (0.075 to 0.125$\mu$m) after ten to sixty minutes of controlled vibration. The process results in metal removal rates of approximately 0.10 mil (2.5$\mu$m) to 3.0 mil (75.0$\mu$m) per hour. These rates are two to 40 times faster than the metal removal rate for vibratory finishing in the absence of a chemical accelerator.

In the process described, barrel finishing machines with diameters of 6 to 18 inches typically are rotated in the range 20 to 60 cycles per minute (cpm); barrels with diameters of 36 to 48 inches generally are rotated at 5 to 15 cpm. Using a sodium bisulfate-tartaric acid accelerator, the metal removal rate in barrel finishing is increased from less than 0.01 to about 0.3 mil per hour.

DESCRIPTION OF THE PREFERRED EMBODIMENTS

The following Examples illustrate preferred embodiments of the process of chemically accelerated vibratory and barrel finishing of zinc die castings.

EXAMPLE 1

An electromagnetic tub with a capacity of 2 cubic feet designed to vibrate a mixture of abrasive media and metal workpieces in a liquid accelerator solution at 3600 cycles per minute with an amplitude of 0.25 inches was used. Plastic cones with a height of ⅜ inch and a diameter of ¼ inch containing abrasive particles having diameters of 5 to 10 microns ($\mu$m) were added to the tub to provide a media to workpiece volume ratio of approximately 5 to 1. The accelerator solution was prepared by dissolving 10 grams of tartaric acid and 10 grams of sodium bisulfate per liter of water. With concentrations of each compound at approximately 10 grams per liter, a pH of 1.5 to 1.6 is obtained. At a pH above 1.9, which is obtained with lower concentrations of tartaric acid and sodium bisulfate, the metal finishing rate decreases considerably; below 1.1, which corresponds to higher concentrations of tartaric acid and sodium bisulfate, the highly acidic solution causes excess roughness on the metal surface.

The accelerator solution was added to the contents of the two cubic feet electromagnetic tub at the constant rate of 3.0 gallons per hour, equivalent to 1.5 gallons per hour per cubic feet, and allowed to drain from the bottom of the tub at the same rate. Using the above-prepared accelerator solution with plastic media in the electromagnetic tub, a surface finish of 0.075 to 0.125 microns (3 to 5 microinches, rms) was obtained after subjecting zinc die castings to treatment for thirty minutes. The metal removal rate was calculated at 0.5 mil (12.5$\mu$m) per hour producing zinc workpieces which had smooth, smut-free surfaces suitable for subsequent plating. The metal removal rate was 7.6 times faster when the accelerator was flushed through the tub than the rate measured for the same load in the same machine flushed with a detergent solution instead of the accelerator solution. The accelerator solution contains the biodegradable substance tartaric acid; therefore, chemical treatment of the waste solution prior to disposal is not necessary.

EXAMPLE 2

A vibratory machine with a capacity of three cubic feet was vibrated at 1200 cycles per minute at an amplitude of 3/16 inch. The machine was loaded with approximately 0.5 cubic feet of zinc die castings and 2.5 cubic feet of abrasive media. The die castings included three different zinc alloys each containing 3.5 to 12 percent aluminum, 0.1 to 1.0 percent copper, and 0.03 to 0.08 percent magnesium. The media used consisted of plastic cones varying in height from ¼ to ¾ inch and embedded with abrasive particles having 5 to 10 $\mu$m diameters. An accelerator solution comprising 40 grams per liter of sodium bisulfate and 10 grams per liter of tartaric acid was flushed through the contents at a constant rate of 4.5 gallons per hour which is equivalent to 1.5 gallons per hour per cubic foot. The pH of this accelerator solution was approximately 1.1.

The zinc die castings were subjected to the chemically accelerated vibratory process for 20 minutes. Representative castings removed from the machine had a surface finish of 8 microinches, rms, and were free of smut and surface residue. The metal removal rate was 0.75 mil per hour (18.75$\mu$m per hour).

EXAMPLE 3

The sodium bisulfate-tartaric acid solution was used in a process of chemically accelerated barrel finishing using a barrel with a diameter of 6 inches, which was set to rotate at 60 cycles per minute. The barrel was loaded with zinc die castings, 30 percent by volume of plastic media, and 40 percent by volume of the chemical accelerator solution. The zinc alloys contained 3.5 to 12 percent aluminum, 0.1 to 1.0 percent copper and 0.03 to 0.08 percent magnesium. The plastic media were embedded with abrasive particles with 5 to 10 $\mu$m diameters. The chemical accelerator solution having a pH of 1.1 consisited of 40 grams per liter of sodium bisulfate and 10 grams per liter tartaric acid.

The zinc die castings were subjected to the chemically accelerated rotating barrel process for 60 minutes. Under these conditions, the zinc workpieces had a surface finish of 13 microinches, rms. The metal removal rate was approximately 0.3 mil per hour (7.5$\mu$m per hour). This metal removal rate is about 50 times greater than the rate for barrel finishing in the absence of the chemical accelerator.

EXAMPLE 4

An accelerator solution consisting of citric acid combined with sodium bisulfate was used in an electromagnetic tub having a capacity of two cubic feet. The electromagnetic tub was loaded with resin-bonded abrasive material in the form of cones with a height of ⅜ inch and a diameter of ¼ inch, and triangles with dimensions of approximately ¼ inch on each side. An accelerator solution comprising 10 g/l of sodium bisulfate and 20 g/l of citric acid, having a pH of 1.65, was added to the contents of the vibratory machine at the constant rate of 2.6 gal/hr and drained from the tub at the same rate. Zinc alloy die castings exposed to the vibrated media and accelerator solution had a surface roughness of 3 to 7 rms microinches after a thirty-minute cycle and a good surface appearance free of smut. The metal removal rate average 6.5 μm/hr (0.25 mil/hr).

EXAMPLE 5

The chemical accelerator solution was added to the contents of an electromagnetic vibratory machine with a capacity of two cubic feet at the constant rate of 3.0 gal/hr and drained from the tub at the same rate. The tub was loaded with resin-bonded plastic cones and a mixture of commercial zinc die castings of various shapes. Some die castings were removed after a 20-minute cycle and others after 30 minutes, but no difference in the surface appearance or roughness was observed. The following results were obtained using a maleic acid accelerator solution, and a maleic acid-sodium bisulfate solution:

| Maleic Acid Concentration, g/l | Sodium Bisulfate Concentration, g/l | Metal Removal Rate, mil/hr | Surface Roughness Microinches, rms |
|---|---|---|---|
| 5 | 0 | 1.5 | 5–6 |
| 5 | 2 | 1.4 | 7–8 |

EXAMPLE 6

A 6-inch-diameter barrel partly loaded with zinc die castings, 30 percent by volume of plastic media containing 5 to 10 μm-diameter abrasive particles, and 40 percent by volume of accelerator solution was rotated at 60 rpm. The barrel was rotated for 30 to 60 minutes. The following table lists the results obtained for various accelerator solutions:

TABLE

| Aliphatic Acid (g/l) | NaHSO (g/l)[4] | pH | Metal Removal Rate, mil/hr | Surface Roughness Microinches, rms |
|---|---|---|---|---|
| Citric (10) | 10 | 1.6 | 0.12 | 14 |
| Citric (20) | 10 | 1.5 | 0.23 | 19 |
| Glycolic (10) | 10 | 1.7 | 0.18 | 21 |
| Lactic (20) | 10 | 1.6 | 0.11 | 20 |
| Malic (20) | 10 | 1.6 | 0.10 | 18 |
| Maleic (10) | 10 | 1.3 | 3.0 | 23 |
| Maleic (10) | 0 | 1.8 | 2.3 | 20 |
| Maleic (20) | 10 | 1.4 | 2.5 | 21 |

It will be understood that the embodiments described above are merely exemplary and that persons skilled in the art may make many variations and modifications. Such variations are intended to be within the scope of the invention as defined in the appended claims.

We claim:

1. A process for chemically accelerated finishing of metal workpieces consisting of zinc and zinc alloys comprising subjecting metal workpieces to agitation in a vibratory machine or a rotating barrel containing abrasive media while an aqueous accelerator solution of an aliphatic acid having from two to six carbon atoms is added to or flushed through the contents of the machine or barrel.

2. A process according to claim 1 wherein the aliphatic acid is a carboxylic acid selected from the group consisting of acids having at least two carboxyl groups or acids having at least one carboxyl and at least one hydroxyl group.

3. A process according to claim 1 wherein the aliphatic acid is selected from the group consisting of maleic, glycolic, lactic, malic, tartaric or citric acids.

4. A process according to claim 1 wherein the concentration of aliphatic acid is in the range 5 to 25 grams per liter.

5. A process according to claim 1 wherein the pH of the accelerator solution is maintained in the pH range 1.1 to 1.9.

6. A process according to claim 1 wherein the metal workpieces are zinc die castings.

7. A process according to claim 1 wherein a vibratory machine vibrates in the range 1200 to 3600 cycles per minute with an amplitude of 0.0625 to 0.25 inch.

8. A process according to claim 1 wherein a rotating barrel is rotated at the rate of 5 to 60 revolutions per minute.

9. A process according to claim 1 wherein the abrasive media are selected from the group consisting of preformed shapes of ceramic or plastic, containing particles of quartz, aluminum oxide or carborundum.

10. A process according to claim 8 wherein the particles range in size from 5 to 100 microns (μm) in diameter.

11. A process according to claim 1 wherein the metal workpiece is subjected to vibratory or rotatory agitation for 10 to 60 minutes.

12. A process according to claim 1 wherein sodium bisulfate is added to the accelerator solution at a concentration in the range 1 to 40 grams per liter.

13. A process for chemically accelerated vibratory finishing of metal workpieces comprising subjecting a zinc die casting to agitation in a vibratory machine designed to vibrate in the range 1200 to 3600 cycles per minute, said machine containing abrasive media selected from the group consisting of preformed shapes of ceramic or of plastic containing embedded particles of quartz, aluminum oxide or carborundum, said particles ranging in size from 5 to 100 microns, and said machine also containing an aqueous accelerator solution of an aliphatic acid having from two to six carbon atoms, and said solution maintained in the pH range 1.1 to 1.9.

14. A process according to claim 13 wherein sodium bisulfate is added to the accelerator solutions at a concentration in the range 1 to 40 grams per liter.

15. A process for chemically accelerated barrel finishing of metal workpieces comprising subjecting a zinc die casting to agitation in a barrel rotated at 5 to 60 revolutions per minute said barrel containing abrasive media consisting of preformed shaped of ceramic or of plastic containing embedded particles of quartz, aluminum oxide or carborundum, said particles ranging in size from 5 to 100 microns, and said barrel also containing an aqueous accelerator solution of an aliphatic acid having from two to six carbon atoms, and said solution maintained in the pH range of 1.1 to 1.9.

16. A process according to claim 15 wherein sodium bisulfate is added to the accelerator solution at a concentration in the range 1 to 40 grams per liter.

* * * * *